United States Patent [19]

Slattery

[11] Patent Number: 4,508,096

[45] Date of Patent: Apr. 2, 1985

[54] COMPACT VERSATILE PORTABLE COOKER

[76] Inventor: Walter T. Slattery, 3439-½ Altura Ave., La Crescenta, Calif. 91214

[21] Appl. No.: 525,561

[22] Filed: Aug. 22, 1983

[51] Int. Cl.[3] ..... F24C 1/16

[52] U.S. Cl. ..... 126/9 R; 126/26; 126/38

[58] Field of Search ..... 126/9 R, 9 B, 26, 38

[56] References Cited

U.S. PATENT DOCUMENTS

| | | | |
|---|---|---|---|
| 561,856 | 6/1896 | Baxter | 126/9 R |
| 1,198,693 | 9/1916 | Bond | 126/9 R |
| 1,209,610 | 12/1916 | Muehleisen | 126/38 |
| 2,473,047 | 6/1949 | Bershad | 126/9 R |
| 2,477,529 | 7/1949 | Sprinkle et al. | 126/9 R |
| 2,511,515 | 6/1950 | Schmitt | 126/9 R |
| 2,627,854 | 2/1953 | Sana | 126/9 R X |
| 3,060,918 | 10/1962 | Meyer | 126/9 |
| 3,812,839 | 5/1974 | Helgeson | 126/38 |

*Primary Examiner*—Larry Jones

*Attorney, Agent, or Firm*—Poms, Smith, Lande & Rose

[57] ABSTRACT

A versatile cooker assembly includes a rectangular fire pan and a cover which may enclose the other parts of the assembly when they are packed for storage. These additional parts include a pair of supporting end plates and a pair of side plates in addition to a grill. Fasteners selectively hold the cover onto the fire pan, or the supporting end plates to the fire pan to mount it off the ground, with transverse ribs on the end plates providing support for the grill at different levels above the fire pan. The front and rear side plates fit tightly into recesses at the edges of the end plates to form a wind screen or a baking chamber; and the cover of the unit may partially or completely enclose the top of the assembly for smoking or baking purposes.

6 Claims, 6 Drawing Figures

COMPACT VERSATILE PORTABLE COOKER

FIELD OF THE INVENTION

This invention relates to portable cooking arrangements.

BACKGROUND OF THE INVENTION

Various portable cooking arrangements have been proposed heretofore, and they include the devices shown in U.S. Pat. Nos. 3,688,757; 3,815,571; 3,892,222; and 4,051,837. Of these patents, only U.S. Pat. No. 3,815,571 is intended to have several uses, and it is very complex and expensive in its construction, with numerous hinges, pivots, latches, hooks, chains, rods, etc. In addition to being relatively complex, there does not appear to be any possible adjustment of the spacing of the grill from the coals, so that baking, smoking, or other modes of cooking could be readily and practically implemented.

Accordingly, a principal object of the present invention is to provide an inexpensive, compact and versatile cooker.

SUMMARY OF THE INVENTION

In accordance with a complete assembly illustrating the present invention, a simple portable cooker may include only seven parts, with two of these parts, the fire pan and the cover serving as the housing in which the other parts may be stored, when the unit is packaged for storage. The other five major parts include the end support plates, front and side panels and grill. Fasteners are provided for either securing the lid to the fire pan when the unit is packaged for storage, or for securing the end support plates to the fire pan to raise the fire pan off the ground, when the unit is set up for cooking. One or more of the side plates may be used as a wind screen, and when baking or smoking operations are in progress, both the front and back side plates are slid into position, and the top may be partially or tightly covering the unit.

The one additional major unit of the system is the grill, and the end support plates are arranged to permit its mounting at several different elevations over the fire pan.

It is a particular feature of the invention that the end support plates, the two side plates, and the grill will all fit into the compact rectangular package formed by the shallow fire pan and the cover secured directly on top of the fire pan.

In accordance with a minor aspect of the invention, the fire pan is provided with a pair of threaded studs at each end, and wing nuts are employed to secure either the cover, or the two end support plates in position secured to the fire pan.

In accordance with a broader aspect of the invention, a rectangular fire pan is provided, and two supporting end plates of substantially the same extent as said fire pan are removably attached to the fire pan to mount it above the ground and to provide several alternative locations for mounting a grill above the fire pan.

Preferably in the foregoing arrangements the side plates are dimensioned to fit within the fire pan for ease and convenience in storage.

Other objects, features and advantages of the invention will become apparent from a consideration of the following detailed description and from the accompanying drawings.

BRIEF DESCRIPTION OF THE DRAWINGS

FIG. 6 shows the cooker unit with the lid slightly tilted at the front for smoking meats or the like.

DETAILED DESCRIPTION

Figure 1:
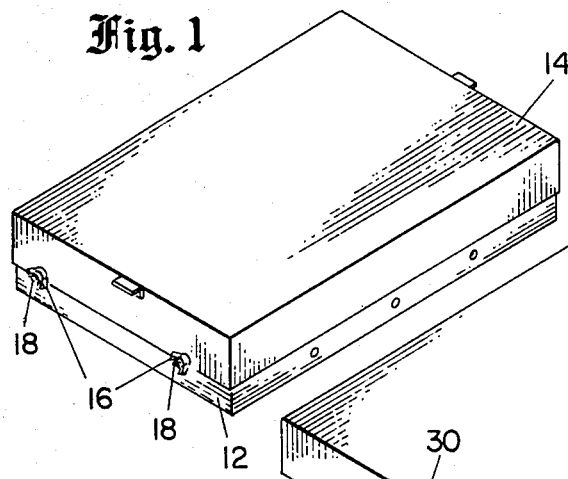
FIG. 1 shows a compact versatile portable cooker illustrating the principles of the present invention in the packaged condition for storage.
Figure 2:
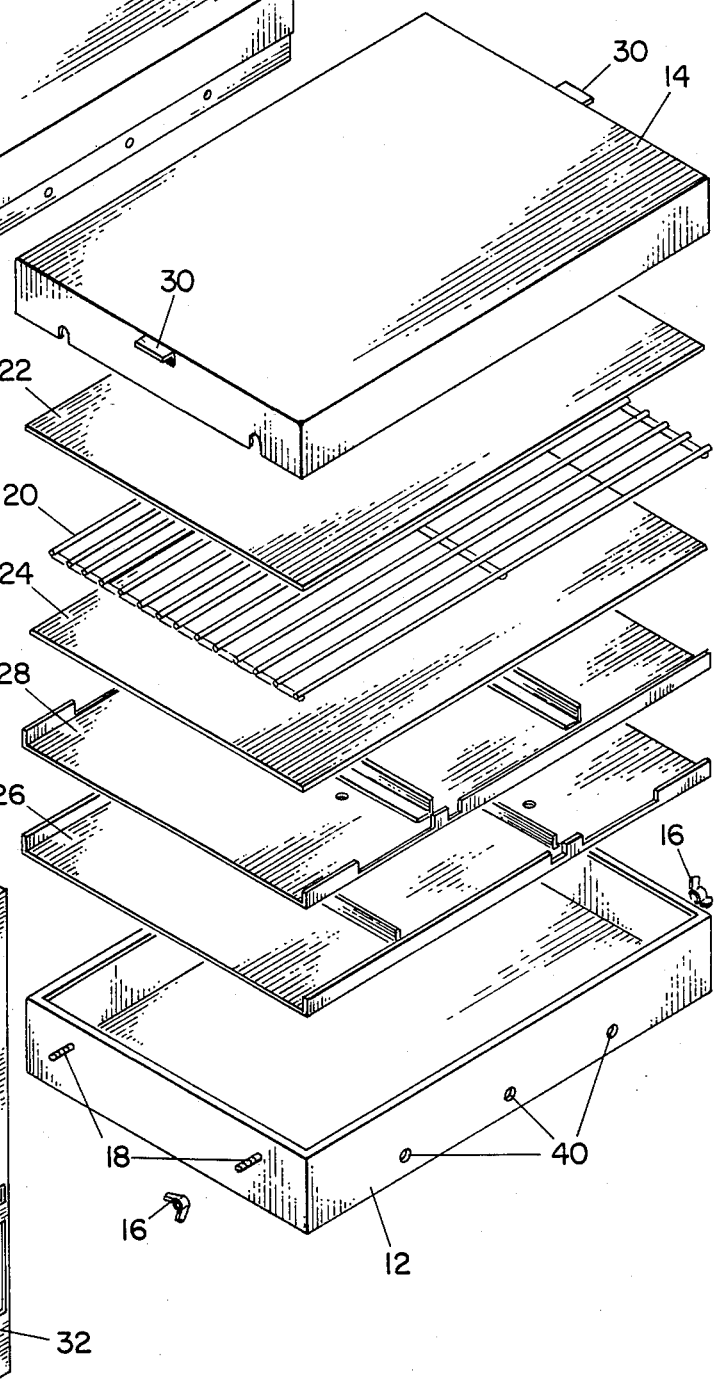
FIG. 2 is an exploded view showing the orientation of the parts of the cooker of FIG. 1 as they will be packaged for storage.

Referring more particularly to the drawings, the versatile cooker illustrating the principles of the present invention is shown packaged up in FIG. 1, with the fire pan 12 being secured to the cover 14 of the unit by the wing nuts 16 which are fastened to threaded studs 18 secured to the ends of the fire pan 12. As shown in FIG. 2 of the drawings, when the unit is packaged up, all of the other parts may be stowed within the fire pan 12 and cover 14. These other parts include the grill 20 which may be stored in the soiled condition between the two side plates 22 and 24 which might have their soiled surfaces facing the grill 20 and their clean surfaces facing outwardly, resting on top of the inturned upper edges of fire pan 12, within the cover 14. The two end support plates 26 and 28 are constructed to fit entirely within the fire pan 12. The cover 14 is provided with handles 30 which may be employed in lifting the lid off of the fire pan after the wing nuts 16 have been loosened. Alternatively, or in addition, another larger handle may be provided on the lid 14.

Figure 3:
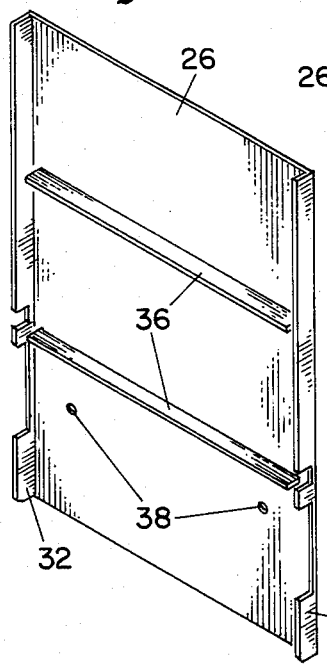
FIG. 3 is an enlarged view of one of the two end support plates of the cooker.

Referring to FIG. 3, a detailed showing of one of the end plates 26 is provided. It includes side flanges 32 to give increased rigidity to the unit, and horizontally extending brackets 36 to support the grill 20 at different heights above the coals which will normally be present in operation, in the fire pan 12. The openings 38 receive the threaded studs 18, and the wing bolts 16 are then spun into place to hold the two end plates securely against the fire pan.

Incidentally, the fire pan 12 is made of heavy gage galvanized steel, such as 18 gage steel or stainless steel, to provide adequate strength to withstand the high temperatures generated by charcoal briquettes or the like. Three drilled holes 40 provide ventilation for the unit so that oxygen is drawn in across the coals and combustion is enhanced.

Figure 4:
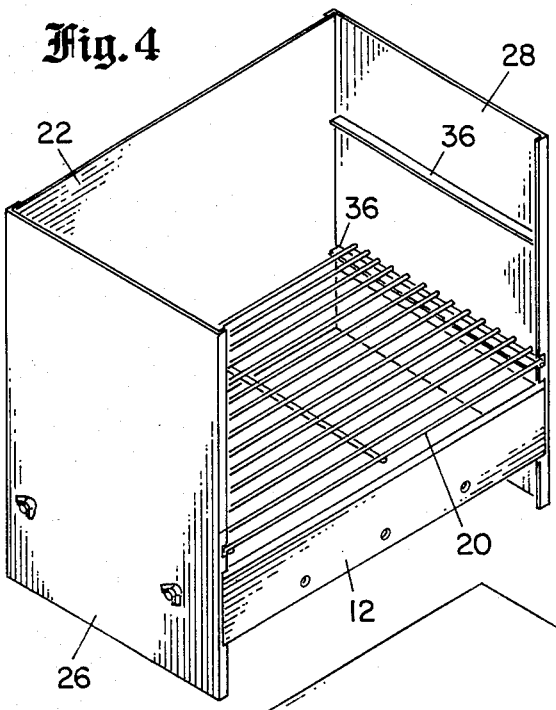
FIG. 4 shows the cooker set up for conventional broiling of steaks or chops, or the like, with the optional wind screen dropped into place.
Figure 6:
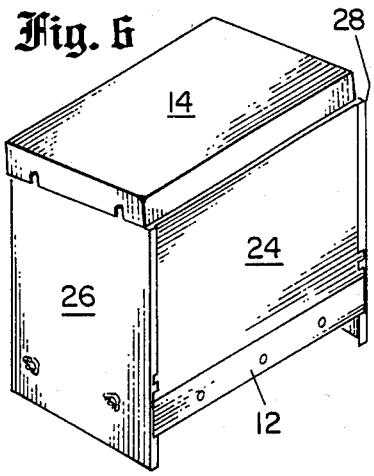
Figure 5:
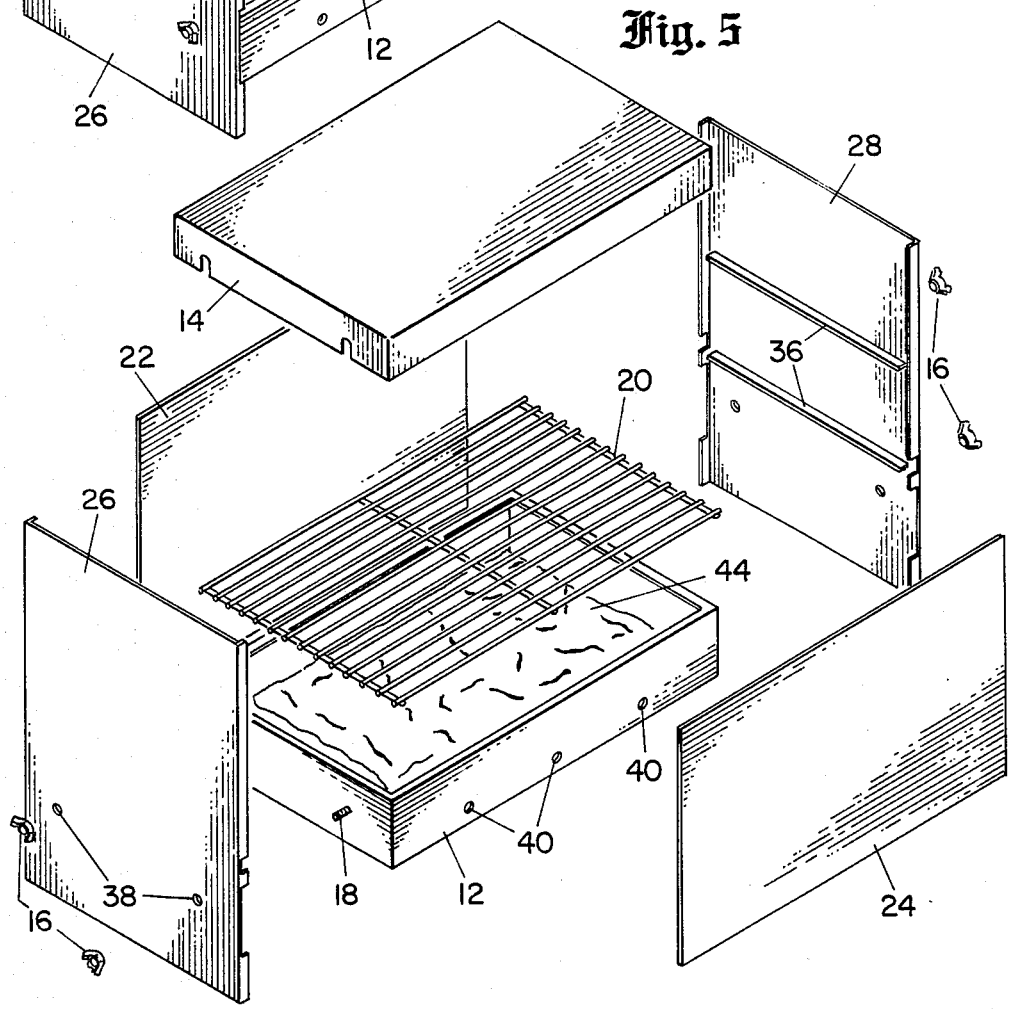
FIG. 5 is an exploded view of the complete cooker unit in the baking configuration.

FIGS. 4, 5 and 6 are generally self-explanatory, particularly when the reference numerals as mentioned hereinabove are employed on all of the various parts. It may be noted that FIG. 4 is the normal configuration for broiling steaks and chops or the like, with the grill 20 being mounted on the lower brackets 36 of the end plate 26 and 28. It may also be noted that the grill 20 may be mounted directly on the top of the fire pan 12 which is provided with a peripheral inwardly extending lip. It may also be noted that there is space in the cutaway portion of the side rails 32, immediately adjacent the fire pan 12, to permit the sliding in of the grill 20 immediately on top of the fire pan 12. The position of the grill 20 as shown in FIG. 4 mounted on one of the brackets 36, is about an inch about its position when it is mounted directly on the fire pan 12.

In the exploded view of FIG. 5, a sheet of aluminum foil 44 is shown lining the fire box 12. This serves to keep the charcoal briquettes which may be employed from burning or seriously soiling the fire pan and makes it cleaner for storage and subsequent re-use. Care must be taken not to block the openings 40, and this can be accomplished by inserting a pencil through these openings after lining with the aluminum foil 44. If desired, adjustable openings 40 may be provided, but the inventor has determined thru usage that a single set of three openings about ¼" in diameter is adequate for all purposes, including grilling, broiling, baking and smoking.

FIG. 6 shows a unit completely assembled, with the lid 44 mounted at an angle on the top to provide a small crack for smoking. When the lid is completely and fully on top of the unit and extending downwardly on all sides, the grill 20 is located on the upper set of brackets 36 on the end support plates 26, 28, and baking may be effectively undertaken.

It is a useful and interesting design feature that the end plates 26 and 28 are slightly smaller than the front and back side plates 22 and 24, and the grill 20, so that the end plates just barely fit within the lip of the fire pan 12 for storage in it. It is also noted that there is a slight space or recess between the ends of the brackets 36, and the side flanges 32 of the end support plates 26 and 28, so that the front and rear side plates 22 and 24 can easily slide from the top down and engage the upper lip of the fire pan 12, to provide a tight seal. No fasteners are required.

As mentioned above, the fire pan 12 is made of heavy gage, for example 18 gage, sheet steel, and the remainder of the sheet metal assembly including parts 22, 24, 26 and 28, as well as the cover 14, may be made of aluminum. The fire pan in one exemplary embodiment was approximately 18 inches long by 12-¾ inches wide, and approximately 2 and ¾ inches deep, with an inturned lip of approximately ¼ to ⅜ of an inch, at its open side. The lid is just a fraction of an inch larger to fit over the fire pan, and it is approximately two inches deep. The two end plates are approximately 17-¾ inches long and about 11-¾ inches wide, with the brackets 36 being about ½ inch in outward extent to support the grill 20. The front and rear side plates 22 and 24 are approximately 12 inches wide by 17-¾ inches long. The grill 20 is approximately 17 and ¾ inches long and approximately 11 inches wide. It is also noted that, with the grill in the upper position, there is more than six inches of space above the grill, and the grill is located more than six inches above the fire pan. It is, of course, to be understood that the foregoing dimensions are merely exemplary, and that the unit could be somewhat larger or smaller, without departing from the spirit and scope of the invention. While the fire pan is preferably formed of galvanized steel, the grill of plated steel and the other sheet metal parts of aluminum, other materials may be employed.

In closing, it is to be understood that the arrangements as shown in the drawings and as specifically described hereinabove, are illustrative of the principles of the present invention. Other arrangements may be employed for the implementation of features of the invention without departing from the principles hereof. Thus, by way of example, and not of limitation, instead of the threaded studs 18 and the wing nuts 16, the end plates 26, 28, and the cover 14, may be provided with interfitting clips to lock together with the fire pan 12 to form appropriate assemblies for the cooking and the storage conditions. Similarly, other arrangements could be employed for supporting the grill and for holding the assembly, within the purview of the present invention. Accordingly, the present invention is not limited to that precisely as shown and described hereinabove.

What is claimed is:

1. A compact versatile portable cooker comprising:

a fire pan of rectangular configuration and having a bottom and four sides;

a cover;

a pair of supporting end plates, said end plates being small enough to fit into said fire pan;

an open rectangular grill member;

means for alternatively securing said cover or said end plates to said fire pan, to provide with said cover a closed container for containing and storing all of the parts of the portable cooker; and to provide with said end plates a support for said grill above the fire pan and with the fire pan raised above the ground or other supporting surface; and said end plates including means for supporting said grill member at several different cooking levels above said fire pan, and said end support plates further including inturned flanges for holding said front and rear side plates in place.

2. A compact versatile portable cooker comprising:

a fire pan;

a pair of supporting end plates, said end plates being small enough to fit into said fire pan for storage;

an open grill;

means for securing said end plates to said fire pan to provide with said end plates a support for said grill above the fire pan and with the fire pan raised above the ground or other supporting surface;

said end plates including means for supporting said grill member at several different cooking levels above said fire pan;

front and rear side plate means for shielding against wind and for enclosing the space above said fire pan and between said end plates;

said end support plates including inturned flanges for holding said front and rear side plates in place; and a cover, said cover being dimensioned to fit over said end and side plates to form an oven;

whereby said cooker can be used for broiling, braking or smoking and can be stowed away within said fire pan and said cover.

3. A compact versatile portable cooker comprising:

a fire pan;

a pair of supporting end plates, said end plates being small enough to fit into said fire pan for storage;

an open grill;

means for securing said end plates to said fire pan to provide with said end plates a support for said grill above the fire pan and with the fire pan raised above the ground or other supporting surface; and said end plates including means for supporting said grill member at several different cooking levels above said fire pan.

front and rear side plate means for shielding against wind and for enclosing the space above said fire pan and between said end plates;

a cover, said cover being dimensioned to fit over said end and side plates to form an oven; and means for supporting said grill at a height more than four inches above the fire pan, and with at least an additional four inches of space to the top of the end and side plates, to facilitate smoking and baking operation;

whereby said cooker can be used for broiling, baking or smoking and can be stowed away within said fire pan and said cover.

4. A compact versatile portable cooker comprising:

a fire pan of rectangular configuration and having a bottom and four sides;

a cover;

a pair of supporting end plates, said end plates being small enough to fit into said fire pan;

an open rectangular grill member;

means for alternatively securing said cover or said end plates to said fire pan, to provide with said cover a closed container for containing and storing all of the parts of the portable cooker; and to provide with said end plates a support for said grill above the fire pan and with the fire pan raised above the ground or other supporting surface;

said end plates including means for supporting said grill member at different cooking levels above said fire pan;

front and rear side plate means for shielding against wind and for enclosing the space above said fire pan and between said end plates;

said side plates and said grill being small enough to fit flat within said cover;

said cover being dimensioned to fit over said end and side plates to form an oven;

means for assembling said cooker with one end of each of said end support plates and one of the side edges of each of said side plates lying substantially in a single plane, to receive said cover for the smoking or cooking modes of operation; and means for storing said end support plates and said side plates within said fire pan and said cover with the sides of said end plates and the sides of said side plates substantially overlying one another, and the ends of said end plates and the ends of said side plates substantially overlying one another;

whereby said cooker can be used for broiling, baking or smoking and can be stowed away within said fire pan and said cover.

5. A compact versatile portable cooker comprising:

a fire pan of rectangular configuration and having a bottom and four sides;

a cover;

a pair of supporting end plates, said end plates being small enough to fit into said fire pan;

an open rectangular grill member;

means for alternatively securing said cover or said end plates to said fire pan, to provide with said cover a closed container for containing and storing all of the parts of the portable cooker; and to provide with said end plates a support for said grill above the fire pan and with the fire pan raised above the ground or other supporting surface;

said end plates including means for supporting said grill member at different cooking levels above said fire pan;

front and rear side plate means for shielding against wind and for enclosing the space above said fire pan and between said end plates;

said side plates and said grill being small enough to fit flat within said cover;

said cover being dimensioned to fit over said end and side plates to form an oven; and said cooker including means for supporting said grill at a height more than four inches above the fire pan, and with at least an additional four inches of space to the top of the end and side plates, to facilitate smoking and baking operations;

whereby said cooker can be used for broiling, baking or smoking and can be stowed away within said fire pan and said cover.

6. A compact versatile portable cooker comprising:

a fire pan of rectangular configuration and having a bottom and four sides;

a cover;

a pair of supporting end plates, said end plates being small enough to fit into said fire pan;

an open rectangular grill member;

means for alternatively securing said cover or said end plates to said fire pan, to provide with said cover a closed container for containing and storing all of the parts of the portable cooker; and to provide with said end plates a support for said grill above the fire pan and with the fire pan raised above the ground or other supporting surface;

said end plates including means for supporting said grill member at different cooking levels above said fire pan;

front and rear side plate means for shielding against wind and for enclosing the space above said fire pan and between said end plates;

said side plates and said grill being small enough to fit flat within said cover;

said cover being dimensioned to fit over said end and side plates to form an oven; and said end support plates including inturned flanges for holding said front and rear side plates in place;

whereby said cooker can be used for broiling, baking or smoking and can be stowed away within said fire pan and said cover.

* * * * *